United States Patent [19]

Nakajima et al.

[11] Patent Number: 4,757,776

[45] Date of Patent: Jul. 19, 1988

[54] THREAD PULL-OUT MECHANISM FOR A SEWING MACHINE

[75] Inventors: Kazutaka Nakajima; Masao Ogawa, both of Nagoya, Japan

[73] Assignee: Brother Kogyo Kabushiki Kaisha, Aichi, Japan

[21] Appl. No.: 27,353

[22] Filed: Mar. 18, 1987

[30] Foreign Application Priority Data

Mar. 20, 1986 [JP] Japan ..... 61-41145[U]

[51] Int. Cl.[4] ..... D05B 47/00; D05B 49/02

[52] U.S. Cl. ..... 112/242

[58] Field of Search ..... 112/58, 242, 243, 245, 112/249

[56] References Cited

U.S. PATENT DOCUMENTS

| | | | |
|---|---|---|---|
| 1,145,643 | 7/1915 | Woodward | 112/242 |
| 3,083,661 | 4/1963 | Patrick | 112/242 |
| 3,408,970 | 11/1968 | Kakinuma | 112/245 |
| 3,465,701 | 9/1969 | Walling | 112/245 |

FOREIGN PATENT DOCUMENTS

| | | | |
|---|---|---|---|
| 687553 | 2/1953 | United Kingdom | 112/242 |
| 1106672 | 3/1968 | United Kingdom . | |

*Primary Examiner*—Andrew M. Falik

*Attorney, Agent, or Firm*—Barnes & Thornburg

[57] ABSTRACT

A thread pull-out mechanism for sewing machines, which pulls out a predetermined amount of the needle thread from the thread supply spool by means of an operating member interlocked with the take-up lever of the sewing machine. A turn-over member for turning over the direction of supply of the needle thread is disposed in a threading path between the thread supply spool and the tension regulating mechanism of the sewing machine to check backward movement of the needle thread in pulling out the needle thread from the thread supply spool. During the thread take-up motion of the take-up lever of the thread take-up mechanism, the needle thread pulled out from the thread supply spool is slackened so that the turn-over member will not exert a significant resistance to the needle thread when the take-up lever pulls the needle thread previously pulled out from the thread supply spool. Thus, the needle thread is pulled by the take-up lever smoothly as the take-up lever is moved upward for thread take-up motion. When the needle thread is pulled out from the thread supply spool by the operating member, the resistance exerted on the needle thread by the tension regulating mechanism acts to increase the resistance of the turn-over member on the needle thread, so that the backward movement of the needle thread is checked effectively while the needle thread is being pulled out from the thread supply spool.

4 Claims, 6 Drawing Sheets

THREAD PULL-OUT MECHANISM FOR A SEWING MACHINE

BACKGROUND OF THE INVENTION

The present invention relates to a thread pull-out mechanism which pulls out needle thread previous to the needle thread tightening motion of the take-up lever and, more specifically, to a thread pull-out mechanism for such a function, having a checking member to check pulling back the needle thread from the take-up lever in pulling out the needle thread from the supply spool.

Generally, the take-up lever, the vertical reciprocatory motion of which being synchronous with the rotation of the arm shaft of the sewing machine, moves downward to supply the needle with an amount of the needle thread necessary for forming a stitch, and then moves upward to tighten the needle thread and to pull out a predetermined amount of the needle thread necessary for forming the subsequent stitch from the supply spool.

Optimum tightening of the needle thread is achieved by enhancing the spring force applied to the tension discs to a certain degree in sewing a comparatively thick fabric, and by reducing the spring force in sewing a comparatively thin fabric. However, when the spring force is reduced to a very low degree in sewing a very thin fabric, and when a large amount of needle thread is wound on the spool or when the spool is supported vertically, resistance to pulling out the needle thread from the spool exceeds the resistance to the movement of the needle thread applied through the tension discs by the spring force, because of the inertia of the spool and a frictional resistance to the rotation of the spool, in pulling out the needle thread from the spool by the upward movement of the take-up lever. Consequently, the take-up lever is unable to pull out a predetermined amount of needle thread from the spool, the tension of the needle thread varies excessively widely and a wavy seam is formed due to an excessive tension applied to the needle thread in tightening the same, and hence it is impossible to form uniform and regular stitches.

To solve such problems, Japanese Utility Model Publication (examined) No. 60-38469 discloses, as shown in FIGS. 6 and 7, a variable pretension device which comprises an annular cam 104 mounted on one end of the arm shaft 102 of a sewing machine beside a balance crank 103, a vertical arm member 105 pivotally supported at the lower end thereof with a pin 106 on the frame 101 of the sewing machine and having a projection engaging the cam surface 104*a* of the annular cam 104, a thread pull-out arm 108 attached to the top of the arm member 105, and a pretension mechanism 121 which presses the needle thread 120 against a tension block 110 when the take-up lever 115 moves downward in synchronism with the rotation of the arm shaft 102 while the thread pull-out arm 108 pulls out the needle thread 120 from the spool 119. And, a pretension disc 113, an elastic member 116, a tension disc 123, a tension spring 124 and a tension adjusting dial 125 are shown in FIGS. 6 and 7.

The pretension mechanism of this pretension device prevents the reverse movement of the needle thread 120 in pulling out the needle thread 120 from the spool 119 by the needle pull-out arm 108. However, this pretension device has many disadvantages. That is, since the pretension device is driven by a cam mechanism, the parts in sliding contact with each other, such as the cam 104 and the projection 105*b* of the arm member 105, generate noise during high speed sewing operation, since the cam surface 104*a* of the cam 104 and the projection 105*b* of the arm member 105 are in sliding contact, the cam surface 104*a* and the projection 105*b* are liable to be abraded during an extended period of use and thereby the amount of the needle thread 120 pulled out in one stitching cycle is variable; since the spring force of the spiral spring 114 of the pretension mechanism for checking the needle thread 120 decreases during an extended period of use, the reverse movement of the needle thread 120 in pulling out the needle thread 120 can not be checked satisfactorily; and since the pretension mechanism comprises many parts, such as the annular cam 104, the arm member 105, the thread pull-out arm 108, the tension finger 109, the tension block 110 and the pretension shaft 112, the pretension device is complex in construction and expensive.

On the other hand, there is provided a thread pull-off mechanism for pulling out the thread of a sewing machine, in U.S. Pat. No. 3,083,661.

Above thread pull-off mechanism is provided with a pull-off finger connected to the take-up crank, having a free end thereof moving reciprocatively up and down, and a predetermined amount of the thread is pulled out from the thread supply source by the pull-off finger. On the front surface of the machine head, there is provided with a pair of guides for guiding the thread in order to pull out the thread by the finger; and these guides are located near the thread tension device. The thread is introduced to the pair of guides via a guide provided on the front top of the machine head.

Between the thread supply source and thread portion to be pulled out by the finger, the thread is bent like L-shape at two points, therefore resistance of the thread passage is comparatively large.

However, in such a case when the thread tension device is adjusted weakly for sewing a thin fabric, and when the thread supply source stores full thread, it is preferable that the resistance of the thread passage is as small as possible, and it is preferable that the resistance is as large as possible in the thread passage between the thread portion to be pulled out by the finger and the thread tension device.

SUMMARY OF THE INVENTION

Accordingly, it is a principal object of the present invention to provide a thread pull-out mechanism for sewing machines, which is reliable in pulling out a predetermined amount of needle thread from the spool.

It is another object of the present invention to provide a thread pull-out mechanism for sewing machines, which has a checking member for checking the movement of the needle thread against the normal needle thread supply direction in pulling out the needle thread from the spool.

It is a further object of the present invention to provide a thread pull-out mechanism for sewing machines, which does not make the thread supply path complex and capable of reducing the tension variation of the needle thread.

The present first invention is a thread pull-out mechanism for a sewing machine having an endwise reciprocative needle, a thread tension regulating device for applying adjustable resistance to the needle thread supplied from a thread supply source to the needle, and a thread take-up lever disposed between the thread tension regulating device and the needle and adapted for reciprocative motion between a first position where the needle thread is taken up to a maximum take-up extent and a second position where the needle thread is slackened to a maximum slack extent, above thread pull-out mechanism comprising : a pair of thread guide members disposed between the thread supply source and the thread tension regulating device; an operating member for pulling out a predetermined amount of the needle thread from the thread supply source while the thread take-up lever moves from the first position to the second position, the operating member being operatively connected with the thread take-up lever so as to reciprocate laterally of supply direction of the needle thread guided by the thread guide members; and a turn-over member disposed adjacent to one of the thread guide members on the side of the thread take-up lever to turn over the needle thread supplied between the operating member and the thread tension regulating device, whereby the turn-over member checks the movement of the needle thread against a normal needle thread supply direction in pulling out the needle thread from the thread supply source.

The present second invention is a thread pull-out mechanism for a sewing machine having a machine frame including an upper arm, a thread supply source placed on the top of the upper arm, an endwise reciprocative needle, a thread tension regulating device for applying adjustable resistance to the needle thread supplied from the thread supply source to the needle, and a thread take-up lever disposed between the thread tension regulating device and the needle and adapted for reciprocative motion between a first position where the needle thread is taken up to a maximum take-up extent and a second position where the needle thread is slackened to a maximum slack extent, above thread pull-out mechanism comprising: a pair of thread guide members for guiding the needle thread supplied between the thread supply source and the thread tension regulating device, the thread guide members being placed on the top of the upper arm; an operating member for pulling out a predetermined amount of the needle thread from the thread supply source while the thread take-up lever moves from the first position to the second position, the operating member being operatively connected with the thread take-up lever so as to reciprocate laterally of supply direction of the needle thread guided by the thread guide members and including a thread catching hook extending upward through an opening formed in the top of the upper arm; and a cover plate extending over the area of motion of the thread catching hook.

The thread pull-out mechanism thus constituted according to the present invention pulls out the needle thread from the thread supply source with the operating member during the vertical reciprocatory motions of the needle and the take-up lever synchronous with the rotation of the arm shaft of the sewing machine. The needle thread is pulled out on the upper stream side near the thread supply source before the thread tension regulating device previous to the needle thread tightening operation of the take-up lever, namely, while the take-up lever is moving downward. In pulling out the needle thread from the thread supply source, only a force corresponding to a resistance to pulling out the needle thread from the thread supply source acts against the direction of supply on the needle thread extending after the operating member, whereas a force corresponding to a large resistance resulting from the passage of the needle thread across the bend in the thread supply path formed by the turn-over member and a force corresponding to the resistance of the thread tension regulating device on the passage of the needle thread act on the needle thread extending between the operating member and the take-up lever mechanism. Accordingly, a predetermined amount of the needle thread is surely pulled out from the thread supply source. Since the needle thread thus pulled out from the thread supply source is slackened while the take-up lever moves upward taking up the needle thread, the resistance resulting from the passage of the needle thread across the bend in the thread supply path decreases to a very low level, and hence the predetermined amount of the needle thread previously pulled out from the thread supply source is supplied via the thread tension regulating device to the take-up lever.

Thus, the thread pull-out mechanism for sewing machines, according to the present invention is formed in a very simple construction having a turn-over member disposed between the operating member and the thread tension regulating device, is capable of surely checking the backward movement of the needle thread, and is able to surely pulling out a predetermined amount of the needle thread from the thread supply source at a predetermined phase of a stitching cycle, so that the tension of the needle thread is stabilized and thereby the quality of sewing a thin fabric is improved. Furthermore, the reliable needle thread checking function of the thread pull-out mechanism enhances freedom in designing the position and direction of the thread supply spool.

DESCRIPTION OF THE PREFERRED EMBODIMENT

Figure 1:
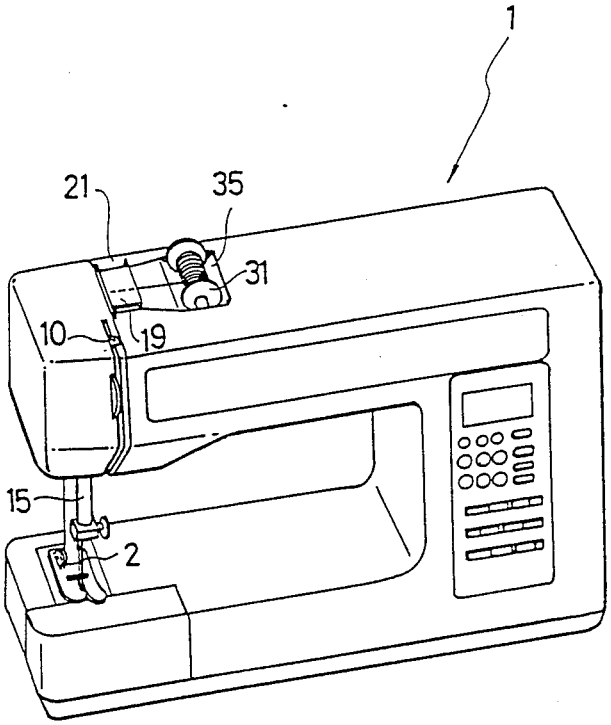
FIG. 1 is a perspective view of an electronic zigzag sewing machine incorporating a thread pull-out mechanism, in a preferred embodiment, according to the present invention.

A preferred embodiment of the present invention will be described hereinafter with reference to the accompanying drawings.

This embodiment comprises a thread guide device disposed in a section between a thread supply spool and a thread tension regulating mechanism (thread supply control mechanism) in the thread supply path of an electronic zigzag sewing machine, for checking the backward movement of the needle thread by turning over the needle thread by a turnover member in pulling out the needle thread from the thread supply spool with an operating member fixed to a control link for reciprocatory motion at a predetermined phase in a stitching cycle.

The thread supply mechanism of this sewing machine comprises: a thread supply spool 31; a thread pull-out mechanism which pulls out a predetermined amount of the needle thread 3 from the thread supply spool 31 previous to taking up the needle thread 3 to tighten the same; a thread tension regulating mechanism which applies a resistance to the needle thread 3 against the direction of supply; a take-up mechanism which supplies a sufficient amount of the needle thread 3 while the needle 2 moves downward penetrating a work fabric, and takes up the needle thread 3 to tighten the same after the needle 2 has penetrated the work fabric, and pulls the needle thread 3 previously pulled out from the thread supply spool 31 by the thread pull-out mechanism, through the thread tension regulating mechanism; and a thread path extending from the thread supply spool 31 via the above-mentioned mechanisms to the needle 2.

The take-up mechanism 4 for taking up the needle thread 3 is synchronism with the vertical reciprocatory motion of the needle 2 is of a conventional linkage type and comprises a take-up lever 5 and a control link 6. The take-up lever 5 is substantially bent in side view and crooked in front view. The take-up lever 5 is connected pivotally at the lower end by a pin 9 to a take-up crank 8 fixed to the arm shaft 7 of the sewing machine. a threading eye 10*a* for threading the needle thread 3 therethrough is formed in the upper free end 10 of the take-up lever 5. The control link 6 has one end pivotally connected by a pin 11 to the substantially middle part of the take-up lever 5 and the other end pivotally connected by a pin 12 to the frame of the sewing machine. The control link 6 controls the take-up lever 5 so that the control lever 5 is moved vertically swinging on the pin 9. Thus, the control link 6 swings on the pin 12 to restrict the range of the swing motion of the middle part of the take-up lever 5 as the pin 9 pivotally supporting the take-up lever 5 at the lower end thereof is moved along a predetermined circular path by the take-up crank 8 fixed to the arm shaft 7. Thus, the take-up lever 5 is driven for vertical reciprocatory motion between an uppermost position indicated by continuous lines where the take-up lever is inclined upward and a lowermost position indicated by imaginary lines where the take-up lever 5 is inclined downward.

When the take-up lever 5 is at the lowermost position, the needle thread 3 is supplied to form a loop below the throat plate of the sewing machine. When the take-up lever 5 is at the uppermost position, the needle thread 3 forming a loop is tightened at a predetermined tension to form a stitch in the work fabric and the needle thread 3 pulled out from the thread supply spool 31 previous to the upward movement of the take-up lever 5 by the thread pull-out mechanism is drawn by the take-up lever 5.

A needle bar crank 13 has one end pivotally supported on the pin 9 and the other end fixedly connected to a needle bar crank pin 14. A needle bar 15 is driven for vertical motion through the needle bar crank 13 by the take-up crank 8.

The thread tension regulating mechanism has a pair of tension discs 16 (thread supply control members) attached to a vertical wall 17 disposed on the left-hand side of the take-up mechanism 4 at a position near the front edge of the left side of the same. The spring force applied to the tension discs 16 to exert a tension appropriate for forming stitches in the work fabric to the needle thread 3 as the same is pulled up by the take-up lever 5 is adjusted by means of a tension adjusting dial 16*a*.

The thread pull-out mechanism 18 for pulling out a predetermined amount of the needle thread 3 from the thread supply spool 31 previous to the thread taking up motion of the take-up lever 5 comprises a thread guide device 19 and an operating member 20. The thread guide device 19 is attached to the top of the arm 21 of the sewing machine 1 at a position above the control link 6. The thread guide device 19 integrally comprises a first guide member 22, a second guide member 23 and a connecting plate 24. The first guide member 22 extends across the thread path along the left side of the vertical wall 17 substantially from the middle part to the rear edge of the vertical wall 17. The first guide member 22 is fixed to the vertical wall 17 by a screw 25 so that the upper part thereof protrudes from the upper surface of the arm 21. The second guide member 23 has the same shape as the upper half of the first guide member 22 and extends in parallel to and on the right-hand side of the first guide member 22 at a predetermined distance from the latter.

Figure 2:
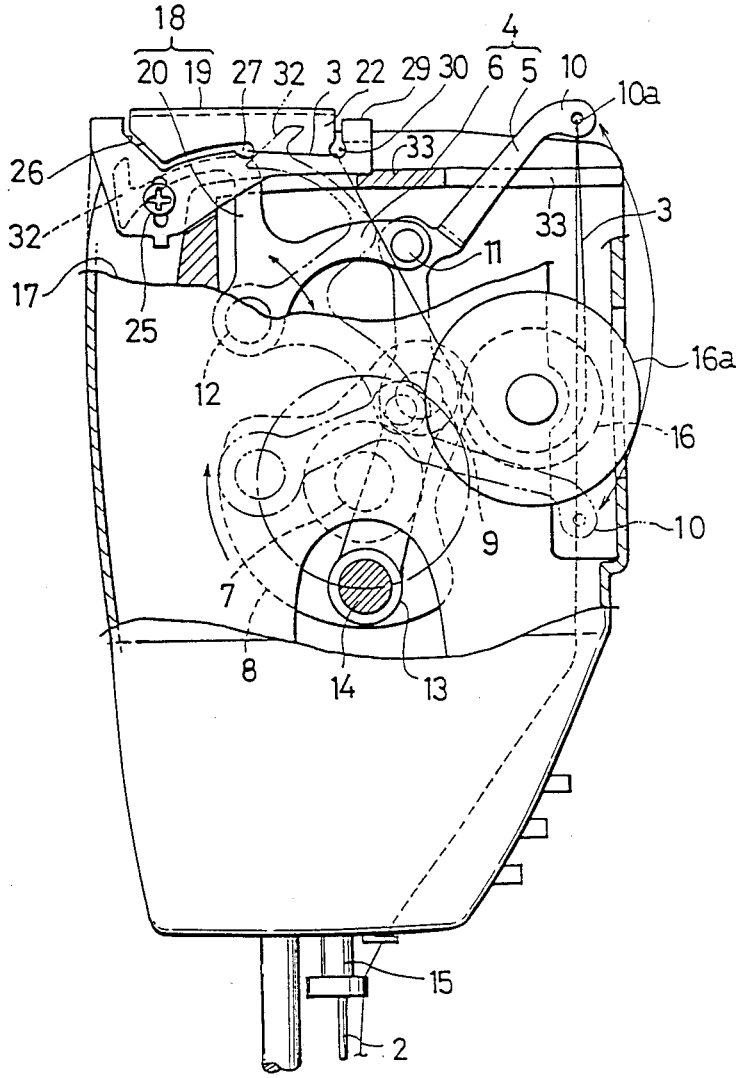
FIG. 2 is a partly cutaway, partly sectional side elevation of the essential portion of the electronic zigzag sewing machine of FIG. 1.

As illustrated in FIG. 2, substantially chevron-shaped guide slits 26 are formed lengthwise in the first guide member 22 and the second guide member 23, respectively, guide the needle thread 3 along a thread path on the front side of the operating member 20, which will be described hereinafter. The rear end of each guide slit 26 opens upward. The respective front ends of the guide slits 26 of the first guide member 22 and the second guide member 23 are expanded to form thread guide eyes 27 and 28, respectively.

Figure 3:
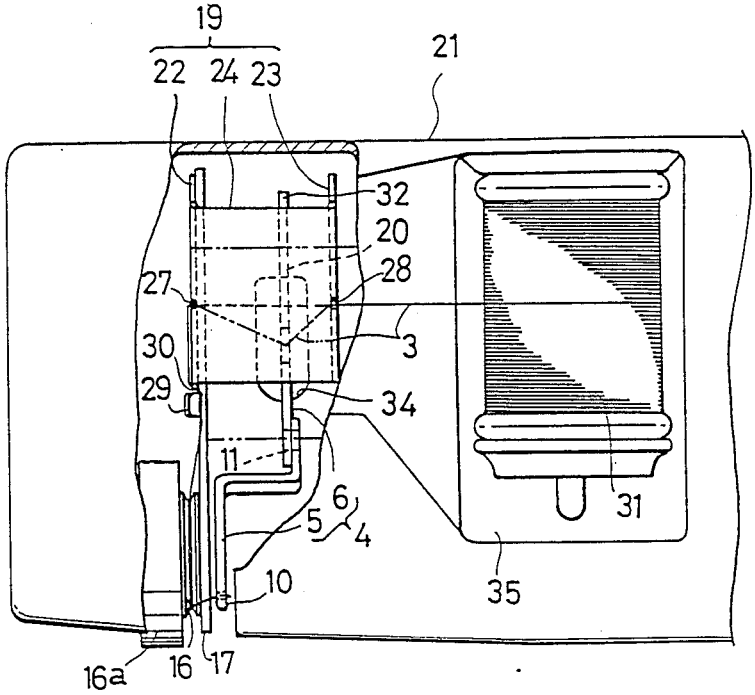
FIG. 3 is a partly cutaway plan view of the portion shown in FIG. 2.

As illustrated in FIGS. 2 and 3, the front end of the lower part of the first guide member 22 is extended to form a turn-over member 29 which turns over the thread path at a position between the thread supply spool 31 and the tension discs 16 to exert a resistance to the needle thread 3 by the edge effect thereof. A vertical guide slit 30 having a guide eye at the bottom is formed in the turn-over member 29. The upper portion of the turn-over member 29 is bent to the left, as viewed in FIG. 3, in a slope to facilitate threading the needle thread 3 through the guide slit 30. A spool pocket 35 is formed in the upper surface of the arm 21 on the right-hand side of the thread guide device 19 to receive the thread supply spool 31 with its axis perpendicular to the direction of supply. The needle thread 3 pulled out from the thread supply spool 31 is passed along a linear threading path to the thread guide eye 28, and then via the thread guide eye 27 and the guide slit 30 to the tension discs 16. As illustrated in FIGS. 2 and 3, the needle thread 3 is turned over sharply from the left-hand side to the right-hand side of the turn over member 29. Accordingly, in pulling out the needle thread 3 from the thread supply spool 31 by the cooperative action of the thread guide device 19 and the operating member 20, a large resistance is applied to the needle thread by the edge effect of the turn-over member 29 to check the movement of the needle thread 3 from the tension discs 16 toward the operating member 20.

As illustrated in FIGS. 2 and 3, the operating member 20 is formed integrally with the control link 6 by bending the lower end of the control link 6 in a crooked shape. A thread catching hook 32 is formed in the rear end of the operating member 20 so as to engage the needle thread 3 from behind. The operating member 20 is disposed between the first guide member 22 and the second guide member 23 and is reciprocated between a frontmost position and a backmost position as the control link 6 is driven for reciprocatory swing motion on the pin 12 to pull the needle thread 3 forward away from the threading path between the thread guide eyes 27 and 28.

As illustrated in FIG. 2, when the take-up lever 5 is at the uppermost position, the operating member 20 is at a waiting position indicated by broken lines and the thread catching hook 32 is positioned far behind the needle thread 3 extending between the thread guide eyes 27 and 28. When the take-up lever 5 is at the lowermost position, the operating member 20 is at an operating position indicated by imaginary lines and the thread catching hook 32 engages the needle thread 3 to pull out a predetermined amount of the needle thread 3 from the thread supply spool 31. That is, when the take-up lever 5 swings downward in phase with the needle 2, the thread catching hook 32 pulls the needle thread 3 extending between the thread guide eyes 27 and 28 forward.

The needle thread 3 is supplied through the thread guide eye 28, the thread guide eye 27, the tension discs 16, a thread take-up spring (not shown) and the threading eye 10a formed in the free end 10 of the take-up lever 5 to the eye of the needle 2.

An opening 34 through which the operating member 20 extends upward and in which the operating member 20 is reciprocated forward and backward is formed in the wall 33 of the frame extending rightward from a position on the right-hand side near the upper edge of the vertical wall 17.

Figure 4:
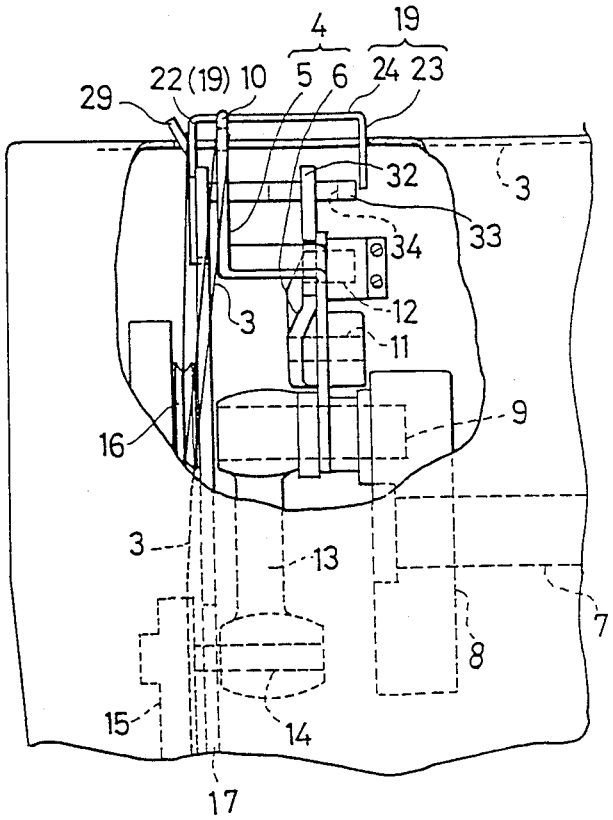
FIG. 4 is a partly cutaway front elevation of the portion shown in FIG. 2.

Functions of the thread pull-out mechanism 18 to pull out a predetermined amount of the needle thread 3 from the thread supply spool 31 prior to the thread taking up operation of the take-up lever 5 will be described hereinafter with reference to FIGS. 2 to 4.

The needle thread 3 is threaded along the threading path from the thread supply spool 31 to the eye of the needle 2. As the take-up lever 5 is moved downward in synchronism with the vertical reciprocatory motion of the needle 2, the needle thread 3 extending between the tension discs 16 and the eye of the needle 2 is moved downward together with the take-up lever 5 and the needle 2 to form a loop below the throat plate, and then the loop is interlocked with the bobbin thread to form a stitch. On the other hand, the operating member 20 is moved forward in phase with the downward movement of the take-up lever 5, thereby the thread catching hook 32 engages the needle thread 3 extending between the thread guide eyes 27 and 28 to pull out a predetermined amount of the needle thread 3 from the thread supply spool 31. When the needle thread 3 is pulled by the thread catching hook 32, the resistance that works on the needle thread 3 on the side of the take-up lever 5 against the pull of the thread catching hook 32 is greater than the resistance that works on the needle thread 3 on the side of the thread supply spool 31 against the pull of the thread catching hook 32. That is, only the resistance of the thread supply spool 31 works on the needle thread 3 against the pull of the thread catching hook 32 on the side of the thread supply spool 31, whereas the resistance resulting from the edge effect of the thread guide eye 27 where the needle thread 3 is turned at an acute angle, the resistance resulting from the edge effect due to the edge effect of the guide slit 30 where the needle thread 3 is turned twice each at a right angle, and the resistance exerted on the needle thread 3 by the tension discs 16 which are pressed against each other by a spring force.

Thus, a predetermined amount of the needle thread 3 is pulled out from the thread supply spool 31 by the forward motion of the thread catching hook 32.

When the take-up lever 5 is moved upward, the needle thread 3 extending between the tension discs 16 and the new stitch is tightened properly by a tension corresponding to the resistance of the tension discs 16 working against the pull of the take-up lever 5. After the needle thread 3 has thus been tightened properly, the needle thread 3 pulled out previously from the thread supply spool 31 and stored in the thread guide device 19 is taken up through the tension discs 16 by the take-up lever 5. The thread catching hook 32 has been moved back to the waiting position to leave the needle thread extending between the guide eye 28 and the tension discs 16 slackened before the take-up lever 5 starts moving upward, the needle thread 3 is released from the edge effect of the guide eye 27 and the guide slit 30 and hence the needle thread 3 can smoothly be taken up by the take-up lever 5 against a very small resistance.

Since the amount of the needle thread pulled out from the thread supply spool 31 by the thread catching hook 32 is dependent on the distance between the first guide member 22 and the second guide member 23, namely, the greater the distance between the first guide member 22 and the second guide member, the smaller is the amount of the needle thread pulled out from the thread supply spool 31, the amount of the needle thread 3 to be pulled out by the thread catching hook 32 in one pull-out cycle may be adjusted by varying the distance between the first guide member 22 and the second guide member 23.

Figure 5:
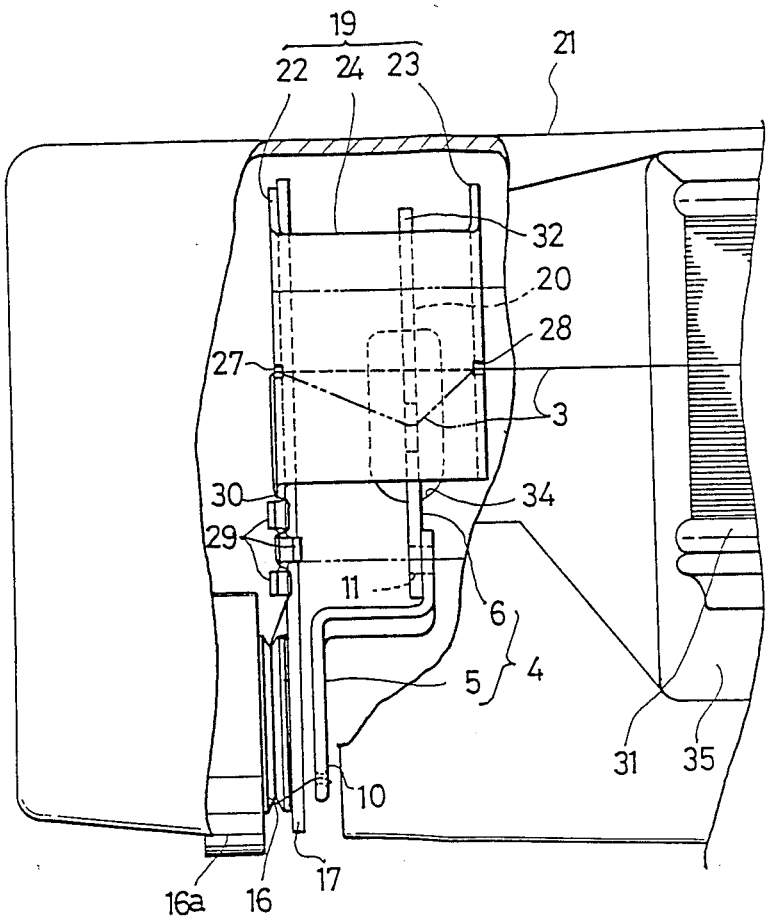
FIG. 5 is a view similar to FIG. 3, showing a modification of a turn-over member.
Figure 6:
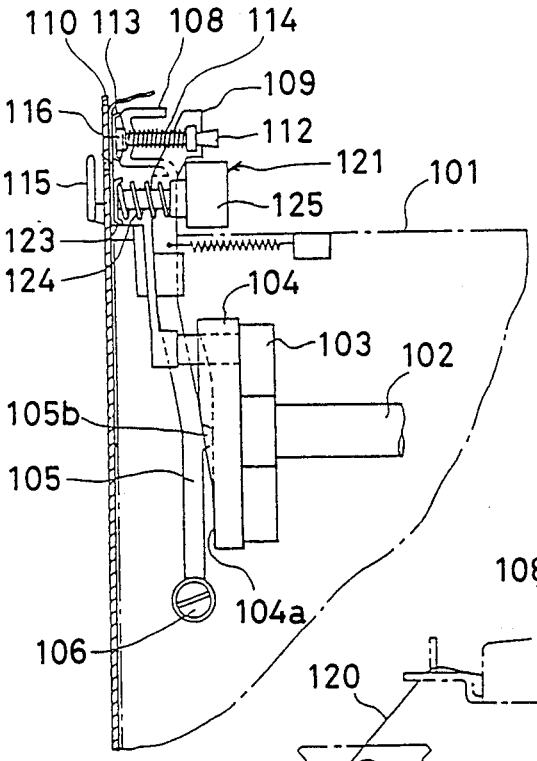
Fig. 6 PRIOR ART
FIG. 6 is a cutaway front elevation showing a thread pull-out mechanism and a pretension device of the prior art.
Figure 7:
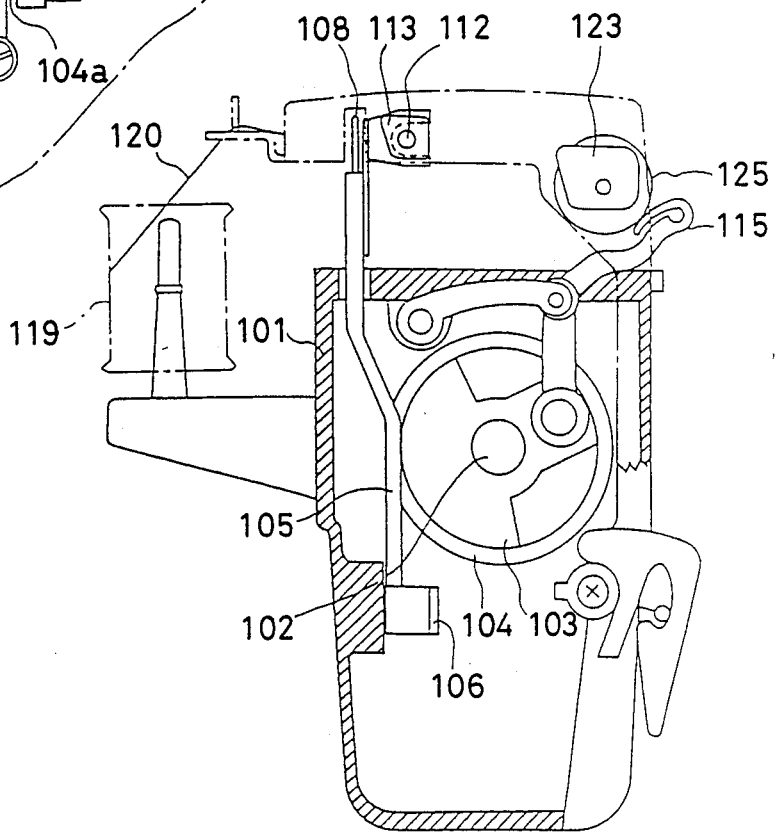
Fig. 7 PRIOR ART
FIG. 7 is a cutaway side elevation of the portion shown in FIG. 6.

It is also possible to form a plurality of turn-over members 29 integrally with the first guide member 22 and to bend the respective upper portions of the turn-over members 29 alternately to the right and to the left as illustrated in FIG. 5 to form a zigzag threading path and to pass the needle thread 3 via all or some of the turn-over members 29 according to the thickness of the needle thread and/or sewing conditions. That is, an appropriate resistance against the pull of the thread catching hook is exerted on the needle thread by properly bending the needle thread 3.

As is apparent from what has been described hereinbefore, the backward movement of the needle thread from the tension discs 16 toward the operating member 20 when the needle thread is pulled by the thread pull-out mechanism 18 is surely checked and inform stitches are formed only by providing the turn-over member or members 29.

What is claimed is:

1. A thread pull-out mechanism for a sewing machine having a machine frame including an upper arm, a thread supply source placed on the top of said upper arm, an endwise reciprocative needle, a thread tension regulating device for applying adjustable resistance to the needle thread supplied from said thread supply source to said needle, and a thread take-up lever disposed between said thread tension regulating device and said needle and adapted for reciprocative motion between a first position where the needle thread is taken up to a maximum take-up extent and a second position where the needle thread is slackened to a maximum slack extent, said thread pull-out mechanism comprising:

a pair of thread guide members for guiding the needle thread supplied between said thread supply source and said thread tension regulating device, said thread guide members being placed on the top of said upper arm;

a thread supply path from said thread supply source to said needle, and being substantially linear between said thread supply source and thread guide members;

an operating member for pulling out a predetermined amount of the needle thread from said thread supply source while said thread take-up lever moves from said first position to said second position, said operating member being operatively connected with said thread take-up lever so as to reciprocate laterally of supply direction of the needle thread guided by said thread guide members and including a thread catching hook extending upward through an opening formed in the top of said upper arm; and a cover plate extending over the area of motion of said thread catching hook, and connected between and integrailly formed with said thread guide members.

2. A thread pull-out mechanism for a sewing machine having an endwise reciprocative needle, a thread tension regulating device for applying adjustable resistance to the needle thread supplied from a thread supply source to said needle, and a thread take-up lever disposed between said thread tension regulating device and said needle and adapted for reciprocative motion between a first position where the needle thread is taken up to a maximum take-up extent and a second position where the needle thread is slackened to a maximum slack extent, said thread pull-out mechanism comprising:

a pair of thread guide members disposed between said thread supply source and said thread tension regulating device;

a thread supply path from said thread supply source to said needle, and being substantially linear between said thread supply source and thread guide members;

an operating member for pulling out a predetermined amount of the needle thread from said thread supply source while said thread take-up lever moves from said first position to said second position, said operating member being operatively connected with said thread take-up lever so as to reciprocate laterally of supply direction of the needle thread guided by said thread guide members; and a turn-over member disposed adjacent to one of said thread guide members on the side of said thread take-up lever to turn over the needle thread at a position where said supply path is turned back between said operating member and said thread tension regulating device;

whereby said turn-over membar checks the movement of the needle thread against a normal needle thread supply direction in pulling out the needle thread from said thread supply source.

3. A thread pull-out mechanism for a sewing machine according to claim 2, said operating member includes a thread catching hook formed integrally therewith.

4. A thread pull-out mechanism for a sewing machine having an endwise reciprocative needle, a thread tension regulating device for applying adjustable resiatance to the needle thread supplied from a thread supply source to said needle, and a thread take-up lever disposed between said thread tension regulating device and said needle and adapted for reciprocative motion between a first position where the needle thread is taken up to a maximum take-up extent and a second position where the needle thread is slackened to a maximum slack extent, and said thread take-up lever being connected pivotally at the lower end with a take-up crank fixed to a main shaft and connected pivotally in the substantially middle part with the free end of a control link which is pivotally mounted on a machine frame, said thread pull-out mechanism comprising:

a pair of thread guide members disposed between said thread supply source and thread tension regulating device;

an operating member formed integrally with said control link for pulling out a predetermined amount of the needle thread from said thread supply source while said thread take-up lever moves from said first position to said second position, said operating member being operatively connected with said thread take-up lever so as to reciprocate laterally of supply direction of the needle thread guided by said thread guide member; and a turn-over member disposed adjacent to one of said thread guide members on the side of said thread take-up lever to turn over the needle thread supplied between said operating member and said thread tension regulating device;

whereby said turn-over member checks the movement of the needle thread against a normal needle thread supply direction in pulling out the needle thread from said thread supply source.

* * * * *